US010254071B2

(12) United States Patent
Dionne

(10) Patent No.: US 10,254,071 B2
(45) Date of Patent: Apr. 9, 2019

(54) FIREARM CONVERSION KIT NOT REQUIRING A DEDICATED FASTENING TOOL

(71) Applicant: General Dynamics Ordnance and Tactical Systems—Canada, Inc., Repentigny (CA)

(72) Inventor: Sylvain Dionne, Lavaltrie (CA)

(73) Assignee: General Dynamics Ordnance and Tactical Systems—Canada, Inc, Repentigny (CA)

( * ) Notice: Subject to any disclaimer, the term of this patent is extended or adjusted under 35 U.S.C. 154(b) by 0 days.

(21) Appl. No.: 15/366,178

(22) Filed: Dec. 1, 2016

(65) Prior Publication Data

US 2017/0160040 A1 Jun. 8, 2017

Related U.S. Application Data

(60) Provisional application No. 62/263,149, filed on Dec. 4, 2015.

(51) Int. Cl.

| | |
|---|---|
| ***F41A 33/00*** | (2006.01) |
| ***F41A 21/00*** | (2006.01) |
| ***F41A 21/48*** | (2006.01) |
| ***F41A 11/00*** | (2006.01) |

(52) U.S. Cl.

CPC ..... *F41A 33/00* (2013.01); *F41A 11/00* (2013.01); *F41A 21/00* (2013.01); *F41A 21/482* (2013.01)

(58) Field of Classification Search

CPC ..... F41A 33/00; F41A 21/00; F41A 21/482; F41A 21/10

USPC ..... 42/77; 89/29, 194, 162

See application file for complete search history.

(56) References Cited

U.S. PATENT DOCUMENTS

| | | | | |
|---|---|---|---|---|
| 2,736,118 | A * | 2/1956 | Clarkson et al. | F41A 21/12 42/75.02 |
| 2,736,119 | A * | 2/1956 | Clarkson et al. | F41A 21/12 42/75.02 |
| 4,228,606 | A * | 10/1980 | Casull | F41A 21/482 42/59 |
| 4,316,339 | A * | 2/1982 | Herriott | F41A 21/488 42/59 |
| 4,608,909 | A * | 9/1986 | Peters | F41A 21/487 42/1.07 |

(Continued)

OTHER PUBLICATIONS

Canadian Intellectual Property Office, International Search Report and Written Opinion for International Application No. PCT/CA2016/051416 dated Feb. 21, 2017.

The International Bureau of WIPO, International Preliminary Report on Patentability for International Application No. PCT/CA2016/051416 dated Jun. 14, 2018.

*Primary Examiner* — Joshua E Freeman

(74) *Attorney, Agent, or Firm* — LKGlobal | Lorenz & Kopf, LLP

(57) ABSTRACT

A conversion kit for a firearm of the type having a removable component is disclosed. The conversion kit includes a chamber piece having a coupling end, and a muzzle piece of a conversion barrel having a coupling end configured to be secured to the coupling end of the chamber piece and an engagement end. The engagement end is configured to mate with the removable component such that manipulation of the removable component causes the coupling end of the muzzle piece of the conversion barrel to be secured to the coupling end of the chamber piece.

4 Claims, 4 Drawing Sheets

(56) References Cited

U.S. PATENT DOCUMENTS

| | | | | | |
|---|---|---|---|---|---|
| 4,707,942 | A * | 11/1987 | Peters | F41A 21/487 | 42/77 |
| 4,833,810 | A * | 5/1989 | Domian | F41A 11/02 | 42/137 |
| 4,920,679 | A * | 5/1990 | Sarles | F41A 21/481 | 42/75.02 |
| 4,955,157 | A | 9/1990 | Brighton et al. | | |
| 5,305,678 | A * | 4/1994 | Talbot | F41A 21/36 | 42/1.06 |
| 5,325,617 | A | 7/1994 | Vojta et al. | | |
| 5,585,589 | A * | 12/1996 | Leiter | F41A 3/54 | 42/75.1 |
| 5,983,773 | A * | 11/1999 | Dionne | F41A 3/86 | 42/77 |
| 6,357,331 | B1 | 3/2002 | Dionne | | |
| 6,571,501 | B1 | 6/2003 | Jennings | | |
| 6,625,916 | B1 * | 9/2003 | Dionne | F41A 3/54 | 102/444 |
| 6,848,208 | B1 * | 2/2005 | Kirschner | F41A 21/16 | 42/77 |
| 8,739,445 | B2 | 6/2014 | Burke et al. | | |
| 8,997,623 | B2 * | 4/2015 | Pflaumer | F41A 3/12 | 89/194 |
| 2003/0177896 | A1 * | 9/2003 | Dionne | F41A 33/00 | 89/33.2 |
| 2017/0160040 | A1 * | 6/2017 | Dionne | F41A 21/00 | |

* cited by examiner

FIREARM CONVERSION KIT NOT REQUIRING A DEDICATED FASTENING TOOL

CROSS-REFERENCE TO RELATED APPLICATIONS

This application claims priority to U.S. Provisional Patent Application No. 62/263,149, filed Dec. 4, 2015, the contents of which are hereby incorporated by reference.

TECHNICAL FIELD

Embodiments of the subject matter described herein relate generally to firearms and, more particularly, to systems and methods for converting such firearms for the purposes of training.

BACKGROUND

Military and law enforcement organizations often seek to employ low-energy training ammunition having a shorter range and lower penetration capacity than standard, original ammunition. In order to facilitate such training, it is desirably to modify the standard or "stock" firearm to fire this low-energy training ammunition. Many weapon conversion kits have been produced and sold in recent years, and due to the increasing use of light-weight polymer materials for weapon receiver and frame parts, more complex geometrical weapon designs are now possible. Previously, such complexity was not a significant concern since nearly all weapon frames and receivers were produced using metals, such as steel, aluminium, or high strength alloys. Newer, more geometrically complicated conversion kit designs often require a two-piece barrel in order for the kit to be assembled onto the duty slide.

U.S. Pat. No. 6,357,331B1, which is incorporated by reference herein, illustrates just one such example, disclosing a conversion kit for a recoil-operating automatic pistol. The conversion kit in this reference includes a two-piece barrel having chamber and muzzle portions that are secured together (e.g., via mating threaded regions) in conjunction with a conversion slide. The chamber portion is installed on the receiver of the stock firearm by insertion through an ejection port of the conversion slide, and the conversion muzzle piece of the conversion barrel is then inserted through the barrel hole of the conversion slide and finally threaded to the chamber piece to complete assembly.

Conversion kits such as those illustrated in the cited reference often require an additional tool to secure the muzzle piece of the conversion barrel to the chamber piece during assembly. For example, in the case where the muzzle piece of the conversion barrel is secured to the chamber piece via mating threaded regions, a wrench or the like is necessary to grip the engagement end of the muzzle piece of the conversion barrel and rotate and securely tighten it into place. While such a method is advantageous in many respects, it requires the addition of an extra tool, which adds complexity, weight, and cost to the kit. In many cases, the end user is responsible for converting his/her duty/service weapon to training mode by installing the conversion kit him/herself. In most cases, special, dedicated or other kinds of tools are not readily available and the need for said tools creates an additional and undesirable logistical burden on any agency/service wishing to employ said training devices. Furthermore, such tools can easily be misplaced or lost, so a two-piece conversion kit barrel presents an additional obstacle for the agencies/services considering the procurement of such weapon training systems.

Accordingly, methods and systems are desired for improved firearm conversion kits. Other desirable features and characteristics of the present invention will become apparent from the subsequent detailed description and the appended claims, taken in conjunction with the accompanying drawings and the foregoing technical field and background.

SUMMARY

In accordance with one embodiment, a conversion kit for a firearm of the type having a removable component is provided. The conversion kit includes a chamber piece having a coupling end, and a muzzle piece of a conversion barrel, the conversion barrel having a coupling end configured to be secured to the coupling end of the chamber piece and an engagement end. The engagement end is configured to mate with the removable component such that manipulation of the removable component causes the coupling end of the muzzle piece of the conversion barrel to be secured to the coupling end of the chamber piece.

In accordance with another embodiment, a method for installing a firearm conversion kit is provided. The method includes installing, within the original firearm, a conversion kit chamber piece having a coupling end; providing a conversion kit muzzle piece of the conversion barrel having a coupling end configured to be secured to the coupling end of the chamber piece and an engagement end; and mating one or more internal structural features of the removable original weapon component to the engagement end of the muzzle piece of the conversion barrel such that manipulation of the removable component causes the coupling end of the muzzle piece of the conversion barrel to be secured to the coupling end of the chamber piece.

In accordance with another embodiment, a method for manufacturing a muzzle piece of a conversion barrel for a firearm is provided. The method includes generating a structural model of a removable component of the firearm, determining a first set of structural features of the structural model of the firearm, and forming an engagement end of the muzzle piece of the conversion barrel such that the engagement end substantially mates with the first set of structural features.

In accordance with another embodiment, a firearm has a removable component and is modified through the use of a conversion kit. The conversion kit includes a chamber piece having a coupling end, and a muzzle piece of a conversion barrel having a coupling end configured to be secured to the coupling end of the chamber piece and an engagement end. The engagement end is configured to mate with the removable component such that manipulation of the removable component causes the coupling end of the muzzle piece of the conversion barrel to be secured to the coupling end of the chamber piece

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Embodiments of the subject matter described herein generally relate to firearm conversion kits that do not require additional tools for assembly. That is, the means for securing the muzzle piece of the conversion barrel to the chamber piece is incorporated into the slide assembly itself. As detailed below, in accordance with one embodiment the engagement end of the muzzle piece of the conversion barrel is configured such that it mates with one or more internal structural features of the stock slide assembly (e.g., the slide assembly that has been removed from the firearm prior to installation of the conversion kit). For example, the engagement end of the muzzle assembly may include two flat gripping surfaces that are substantially parallel to each other and have a distance that is substantially equal to the distance between two available inner walls of the stock slide assembly.

Figure 1:
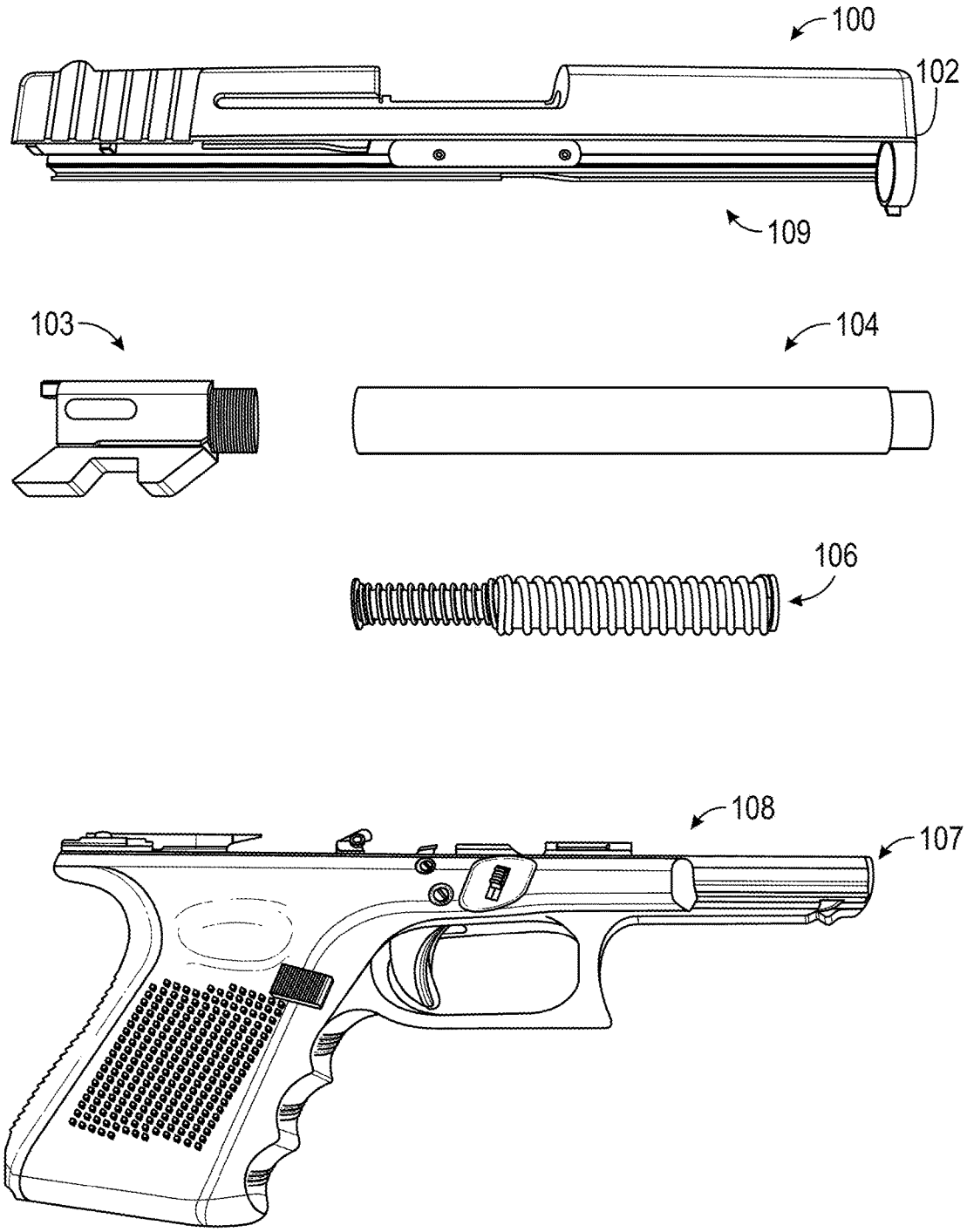
FIG. 1 is an overview of an exemplary firearm and conversion kit in a disassembled state.

Referring now to FIG. 1, an exemplary firearm 100 (in this case, a pistol) is shown in the disassembled state prior to installation of a conversion kit in accordance with one embodiment. As mentioned above in the Background section, U.S. Pat. No. 6,357,331B1, illustrates a conversion kit for a recoil-operating automatic pistol that includes a two-piece barrel assembly having chamber portion (103) and a muzzle portion (104) that are secured together (e.g., via mating threaded regions). The conversion kit further includes a slide assembly (or simply "slide") 102. The barrel assembly (103 and 104) and slide assembly 102 are installed along with the recoil spring assembly 106 (part of the stock firearm) onto the frame assembly (or simply "frame") 107. That is, the bottom side 109 of slide assembly 102 is slideably secured to top side 108 of frame 107. It will be appreciated that the use of the terms "top" and "bottom" in this context is arbitrarily and used with respect to the orientation of firearm 100 as illustrated in FIG. 1. Such terms are not intended to be limiting. Furthermore, the installation and operation of the particular conversion kit need not be described in detail herein, as such information may be found in U.S. Pat. No. 6,357,331B1, which has been incorporated by reference.

It should also be understood that the figures shown and described herein are intended to illustrate just one example firearm, and that the present invention is not limited to any particular type of firearm. Systems and methods in accordance with the present invention may be used, for example, in connection with pistols, machine guns, submachine guns, rifles/carbines, shotguns, revolvers, and any other firearm now known or later developed.

Figure 2:
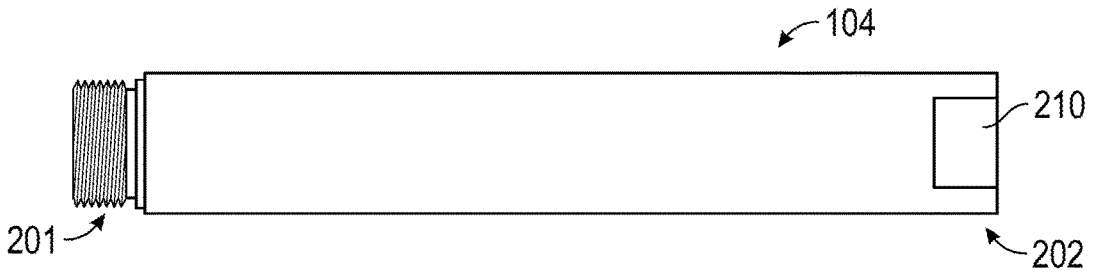
FIG. 2 is a side view of a muzzle piece of the conversion barrel in accordance with one embodiment.

Referring now to FIG. 2, muzzle piece of the conversion barrel 104 generally includes a first end 201 (the "coupling end") configured to be secured (e.g., via a threaded region as illustrated) to the chamber piece 103 of FIG. 1, and an opposite second end 202 (or "engagement end"). It will be understood that muzzle piece of the conversion barrel 104 may be secured to chamber piece 103 in any suitable manner, and that the present invention is not limited to threaded engagement as shown in the example.

Figure 3:
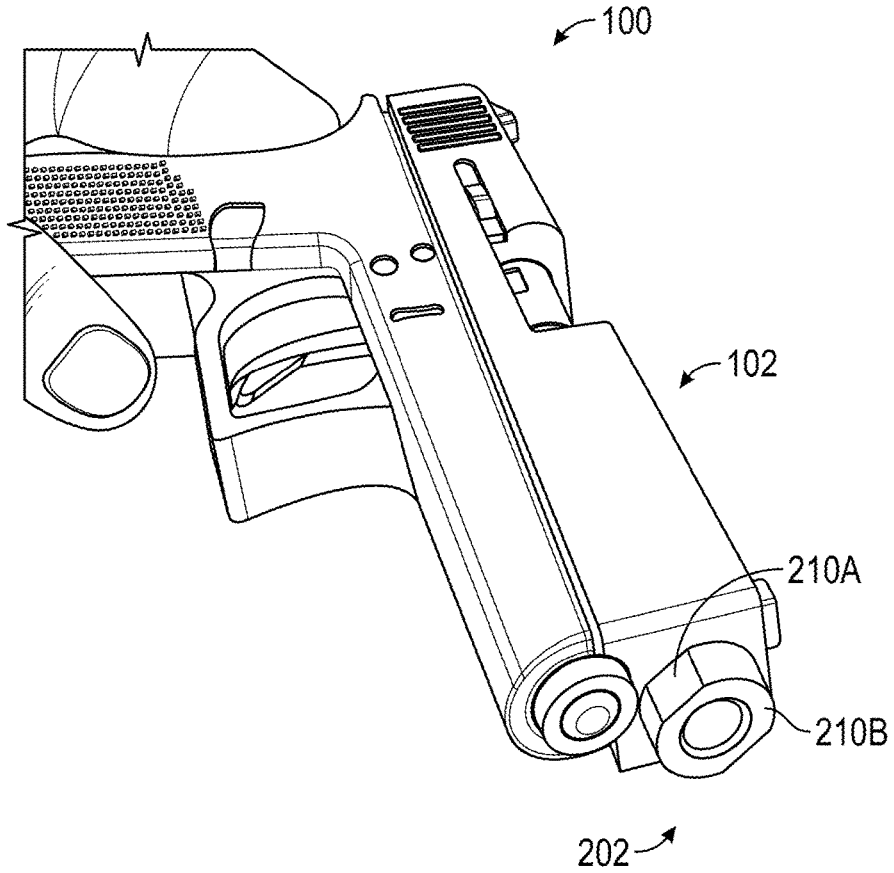
FIG. 3 is an overview of a muzzle piece of the conversion barrel inserted within a slide assembly of an assembled, converted firearm in accordance with one embodiment.

Engagement end 202 includes any suitable structural feature or features that achieve the objects of the present invention. Referring for example to FIG. 3 (which illustrates muzzle piece of the conversion barrel 104 after being installed within firearm 100) engagement end 202 may include one or more flat or curvilinear "gripping surfaces" (e.g., generally planar or curvilinear regions). In the illustrated embodiment, for example, engagement end 202 includes two substantially parallel gripping surfaces 210A and 210B.

Engagement end 202 is not limited to the embodiment shown in FIG. 3, however. Engagement end 202 may include any number, type, and shape of structural features that allow muzzle piece of the conversion barrel 104 to be installed in firearm 100 via one or more internal structural features of the stock slide assembly, as described in further detail below. For example, engagement end 202 may have an axial cross-section that is a regular or irregular a polygon (such as a triangle, a square, a pentagon, a hexagon, etc.). Engagement end 202 may also include any number of slots or protrusions intended to mate with a corresponding slide structure. Engagement end 202 may have a curvilinear or other such shape particularly designed to mate with the slide assembly or other removable component.

Figure 4:
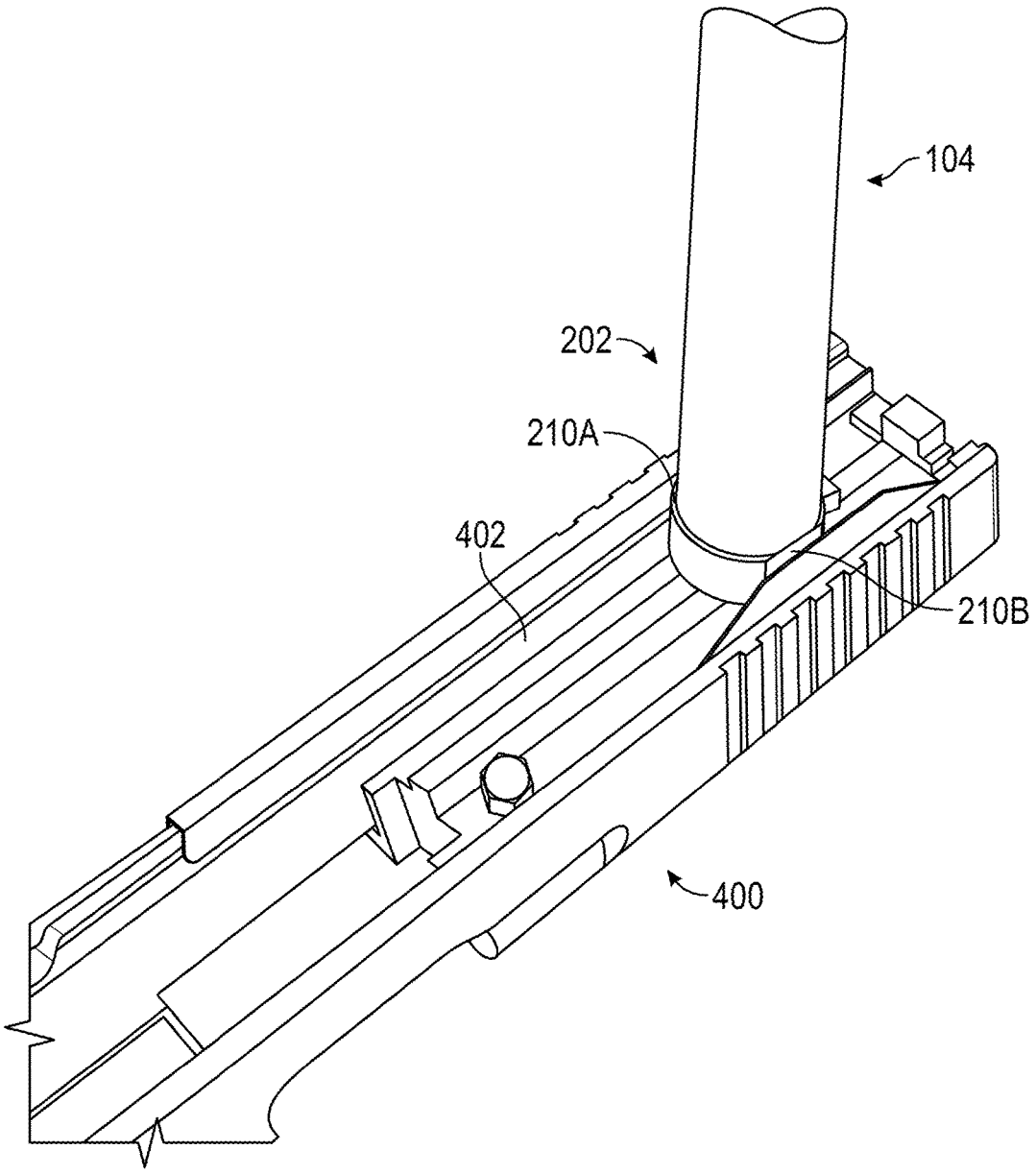
FIG. 4 is an isometric view illustrating a slide assembly engaging an engagement end of the muzzle piece of the conversion barrel.

FIG. 4 shows one example in which muzzle piece of the conversion barrel 104 includes, at its engagement end 202, two flat gripping surfaces 210A and 210B as illustrated in FIG. 3. Engagement end 202 is configured to mate with a corresponding structure or structures (generally referred to as 402 in FIG. 4) within stock slide 400—i.e., the slide that was removed from the firearm in preparation for installing the conversion kit. FIG. 4 illustrates the "underside" of slide 400 (i.e., the side that would generally interface with the top side 108 of frame 107 shown in FIG. 1). Rotation of slide 400 (within a plane substantially orthogonal to the axis of muzzle piece of the conversion barrel 104) thus causes the rotation of muzzle piece of the conversion barrel 104. In this way, slide 400 is effectively the only "tool" required for installation of the conversion kit; no additional wrench or other tool part is required.

Figure 5:
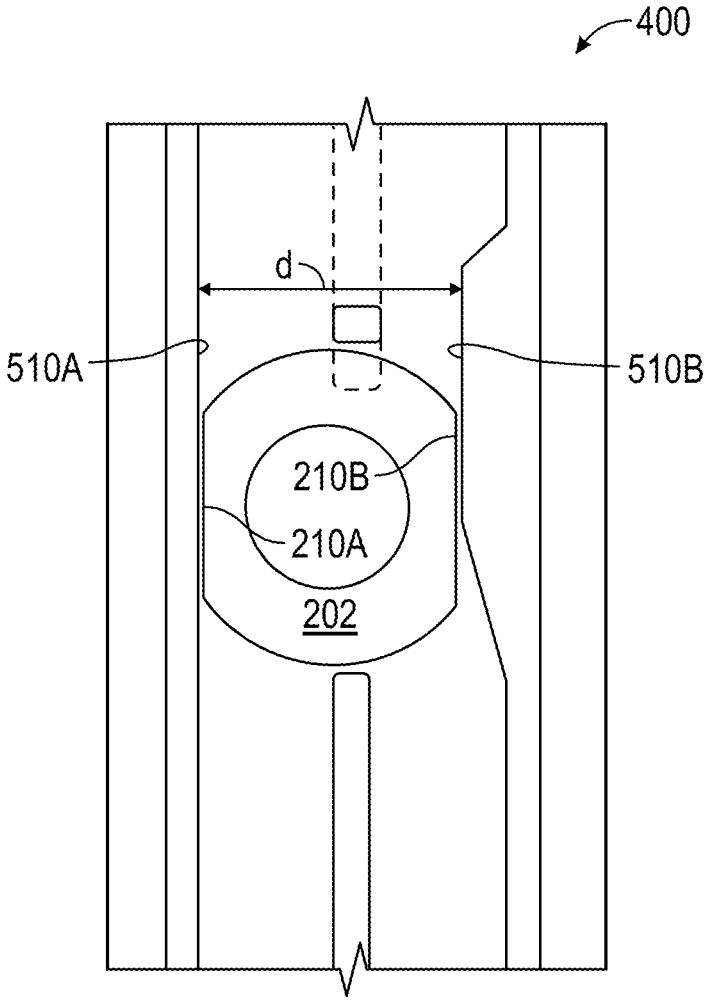
FIG. 5 is a conceptual view illustrating an original slide assembly engaging an engagement end of the muzzle piece of the conversion barrel in accordance with one embodiment.

FIG. 5 illustrates, conceptually, the example shown in FIG. 4. The shaded region corresponds to engagement end 202 of muzzle piece of the conversion barrel 104 (as seen head-on, or axially). As shown, engagement end 202 includes two generally parallel flat surfaces 210A and 210B that engage with corresponding inner walls or other surfaces 510A and 510B, respectively. That is, the distanced between inner walls 510A and 510B is substantially equal to the distance between surfaces 210A and 210B. In this context, the phrase "substantially equal" means that distance d is greater than or equal to the distance between surfaces 210A and 210B but not so large that slipping of slide 400 during rotation occurs. Other features of the underside of slide 400 may or may not assist in keeping engagement end 202 in place during rotation.

In summary, what has been described is a conversion kit that does not require additional tools for assembly. The means for securing the muzzle piece of the conversion barrel to the chamber piece is incorporated into the original slide assembly or other removable original weapon component itself. A method for manufacturing such a muzzle piece of the conversion barrel of a conversion kit for a firearm then generally includes generating a structural model of a removable component of the firearm (e.g., via a general purpose computer having suitable computer-aided design software installed therein); determining a first set of structural features of the structural model of the firearm (e.g., a pair of generally parallel walls); then forming an engagement end of the muzzle piece of the conversion barrel such that the engagement end substantially mates with the first set of structural features. This process may be employed in connection with any available removable original weapon component (e.g., not just slide assemblies) for any type of firearm.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application. Accordingly, details of the exemplary embodiments or other limitations described above should not be read into the claims absent a clear intention to the contrary.

What is claimed is:

1. A method for installing a firearm conversion kit, the method comprising:

installing, within the original firearm, a conversion kit chamber piece having a coupling end;

providing a conversion kit muzzle piece of the conversion barrel having a coupling end configured to be secured to the coupling end of the chamber piece and an engagement end; and mating one or more internal structural features of the removable original weapon component to the engagement end of the muzzle piece of the conversion barrel such that manipulation of the removable component causes the coupling end of the muzzle piece of the conversion barrel to be secured to the coupling end of the chamber piece.

2. The method of claim 1, wherein the removable component is the stock slide assembly of the firearm.

3. The method of claim 2, wherein the engagement end of the muzzle piece of the conversion barrel includes at least one planar or curvilinear gripping surface and the stock slide assembly includes at least one corresponding planar or curvilinear gripping surface for mating therewith during installation of the conversion kit.

4. The method of claim 3, wherein the engagement end includes two, generally planar gripping surfaces and the stock slide assembly includes two corresponding generally planar inner walls for mating therewith.

* * * * *